United States Patent [19]

Dumas

[11] Patent Number: 4,522,686

[45] Date of Patent: Jun. 11, 1985

[54] AQUEOUS SIZING COMPOSITIONS

[75] Inventor: David H. Dumas, Wilmington, Del.

[73] Assignee: Hercules Incorporated, Wilmington, Del.

[21] Appl. No.: 511,445

[22] Filed: Jul. 7, 1983

Related U.S. Application Data

[63] Continuation of Ser. No. 302,010, Sep. 15, 1981, abandoned.

[51] Int. Cl.[3] ..... D21H 3/34

[52] U.S. Cl. ..... 162/158; 162/180; 106/218; 106/238

[58] Field of Search ..... 162/158, 180, 179, 135; 106/218, 219, 238

[56] References Cited

U.S. PATENT DOCUMENTS

| | | | |
|---|---|---|---|
| 3,130,118 | 4/1964 | Chapman | 162/175 |
| 3,212,961 | 10/1965 | Weisgerber | 162/158 |
| 3,957,574 | 5/1976 | Anderson | 162/167 |
| 3,966,654 | 6/1976 | Aldrich | 162/180 |
| 4,017,431 | 4/1977 | Aldrich | 162/158 |
| 4,222,820 | 9/1980 | Hiskens et al. | 162/158 |
| 4,240,935 | 12/1980 | Dumas | 162/158 |
| 4,243,481 | 1/1981 | Dumas | 162/158 |
| 4,302,283 | 11/1981 | Blitzer et al. | 162/158 |

FOREIGN PATENT DOCUMENTS

| | | | |
|---|---|---|---|
| 55-132799 | 10/1980 | Japan | 162/158 |
| 1533434 | 11/1980 | United Kingdom . | |

*Primary Examiner*—Peter Chin

*Attorney, Agent, or Firm*—Hazel L. Deming

[57] ABSTRACT

Described are sizing compositions in the form of aqueous dispersions comprising a hydrophobic cellulose-reactive sizing agent such as a ketene dimer, fortified rosin and a water-soluble, nitrogen-containing cationic dispersing agent. The compositions are highly efficient internal or surface sizing agents for paper and maximize the advantages of each sizing component while minimizing the disadvantages.

10 Claims, No Drawings

AQUEOUS SIZING COMPOSITIONS

This application is a continuation of application Ser. No. 302,010, filed 9/15/81, now abandoned.

This invention relates to paper sizing compositions and more particularly to aqueous compositions containing hydrophobic cellulose-reactive sizes and fortified rosin.

Aqueous dispersions containing finely divided particles of fortified rosin, a water-soluble cationic resin dispersing agent and water are described by Aldrich in U.S. Pat. No. 3,966,654. The aqueous fortified rosin dispersions are useful as internal or surface sizing agents for paper. Sizing performance, however, is dependent on both pH and concentration and it is necessary to use greater than about 0.1% fortified rosin based on the dry weight of the pulp (the critical level) and to carry out sizing in acidic systems to achieve good sizing efficiency.

Sizing compositions which are aqueous emulsions or dispersions of a hydrophobic cellulose-reactive sizing agent such as a ketene dimer and a nonionic, anionic or cationic dispersing agent are also known. The cellulose-reactive sizing agents and particularly the ketene dimer sizing agents have become commercially important since sizing can be effected under alkaline conditions which do not adversely effect the paper strength and higher sizing can be achieved at a lower critical level than is realizable with rosin sizes. They suffer one serious drawback, however, in that drying is required for initial sizing to develop and the ultimate sizing which can be expected does not develop for a significant period of time depending upon the conditions of use.

One approach which has been suggested for accelerating size development with cellulose-reactive sizes involves adding certain water-soluble cationic thermosetting resins to the dispersions. Compositions of this type are described, for example, in British Pat. No. 1,533,434 and U.S. Pat. No. 4,240,935. Although these compositions provide substantial improvement in the rate of size development, complete drying is required to achieve ultimate sizing. With ground wood pulp and other difficult-to size pulps, however, aging is required to achieve ultimate sizing.

Now in accordance with this invention there are provided aqueous dispersions which contain both fortified rosin and cellulose-reactive sizes and which, surprisingly, overcome the disadvantages inherent to the use of either of the components individually. The dispersions of this invention also provide the advantages of the individual components and additionally provide higher and more rapid sizing than would be expected from either component alone.

The aqueous dispersions of this invention have as the continuous phase an aqueous solution containing at least one water-soluble nitrogen-containing cationic dispersing agent and as the dispersed phase (a) finely divided particles of fortified rosin and (b) finely divided particles of a hydrophobic cellulose-reactive sizing agent selected from the group consisting of ketene dimers, organic acid anhydrides, organic isocyanates and mixtures thereof, the weight ratio of (a):(b) in the dispersed phase being within the range of 0.1:1 to 10:1 and the amount of dispersing agent being within the range of about 5 to about 140% based on the weight of the dispersed phase.

The fortified rosin component of the dispersed phase is the adduct reaction product of rosin and an acidic compound containing the

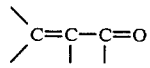

group and is derived by reacting rosin and the acidic compound at elevated temperatures of from about 150° C. to about 210° C.

The amount of acidic compound employed will be that amount which will provide fortified rosin containing from about 1% to about 12% by weight of adducted acidic compound based on the weight of the fortified rosin. Methods of preparing fortified rosin are disclosed and described in U.S. Pat. Nos. 2,628,918 and 2,684,300, reference to which is hereby made.

Examples of acidic compounds containing the

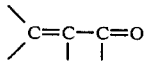

group that can be used to prepare the fortified rosin include the alpha-beta-unsaturated organic acids and their available anhydrides, specific examples of which include fumaric acid, maleic acid, acrylic acid, maleic anhydride, itaconic acid, itaconic anhydride, citraconic acid, and citraconic anhydride. Mixtures of acids can be used to prepare the fortified rosin if desired. Also mixtures of different fortified rosins can be used if desired. Thus, for example, a mixture of the acrylic acid adduct of rosin and the fumaric acid adduct can be used to prepare the novel dispersions of this invention. Also fortified rosin that has been substantially completely hydrogenated after adduct formation can be used.

The fortified rosin can be extended if desired by known extenders therefor such as waxes (particularly paraffin wax and microcrystalline wax); hydrocarbon resins including those derived from petroleum hydrocarbons and terpenes; and the like. This is accomplished by blending with the fortified rosin from about 10% to about 100% by weight based on the weight of fortified rosin of the fortified rosin extender.

Also blends of fortified rosin and rosin; and blends of fortified rosin, rosin and rosin extender can be used. Fortified rosin—rosin blends will comprise about 25% to 95% fortified rosin and about 75% to 5% rosin. Blends of fortified rosin, rosin, and rosin extender will comprise about 25% to 45% fortified rosin, about 5% to 50% rosin, and about 5% to 50% rosin extender.

If rosin (that is, unfortified rosin) is used in combination with fortified rosin, it can be any of the commercially available types of rosin, such as wood rosin, gum rosin, tall oil rosin, and mixtures of any two or more, in their crude or refined state. Partially or substantially completely hydrogenated rosins and polymerized rosins, as well as rosins that have been treated to inhibit crystallization such as by heat treatment or reaction with formaldehyde, can be employed.

Aqueous dispersions containing finely divided particles of fortified rosin are commercially available. One method for preparing such dispersions is described by Aldrich in U.S. Pat. No. 3,966,654 and involves first dissolving the fortified rosin in a water-immiscible organic solvent therefor such as, for example, benzene, xylene, chloroform, methylene chloride and 1,2-dichloropropane. Mixtures of two or more solvents can be used if desired. The selected solvent will also be nonreactive to the components of the aqueous dispersion to be subsequently prepared. The organic solvent-fortified rosin solution is then mixed with an aqueous solution of a cationic dispersing agent to provide an emulsion which is essentially unstable and in which the organic solvent-fortified rosin solution forms the dispersed phase. The essentially unstable aqueous emulsion is then subjected to extreme shear to provide an essentially stable aqueous emulsion. Extreme shear is conveniently accomplished by means of an homogenizer. Thus passing, at least once, the unstable aqueous emulsion through an homogenizer under a pressure of the order of from about 1000 p.s.i.g. to about 8000 p.s.i.g., will provide an essentially stable emulsion. Subsequently, the organic solvent component of the emulsion is removed from the emulsion and there is provided an essentially stable aqueous dispersion of fortified rosin particles. Alternatively, the organic solvent-fortified rosin solution can be mixed with an aqueous solution of a cationic dispersing agent in an amount to provide a stable water-in-oil emulsion which is subsequently inverted to a stable oil-in-water emulsion by the rapid addition of water with vigorous stirring. The organic solvent is subsequently removed, as by distillation under reduced pressure.

The dispersing agent can be any of the known dispersing agents for rosin size and can be nonionic, anionic or cationic in nature. Particularly preferred are the cationic thermosetting water-soluble polyaminopolyamide-epichlorohydrin resins, alkylenepolyamine-epichlorohydrin resins and the poly(diallylamine)-epichlorohydrins resins. These resins are described in U.S. Pat. Nos. 2,926,116; 2,926,154 and 3,700,623 as well as 3,966,654.

Another method for preparing aqueous dispersions of fortified rosin is described by Aldrich in U.S. Pat. No. 3,817,768. This method involves first forming an unstable aqueous dispersion containing fortified rosin and a small amount of a salt of rosin base material, as a dispersing agent, heating the unstable dispersion to about 150° C. to about 195° C. and then subjecting the heated dispersion to extreme shear, as by passing through an homogenizer under a pressure of from about 2000 to about 8000 p.s.i. to provide an essentially stable dispersion. Other anionic dispersing agents such as the salts of alkylaryl sulfonic acid, salts of dialkyl esters of sulfosuccinic acid, salts of alkyl half esters of sulfuric acid and salts of alkylphenoxy (polyethyleneoxy) ethanol half esters of sulfuric acid are also said to be useful in this method in Australian Pat. No. 483,349.

Yet another suitable method for preparing aqueous fortified rosin dispersions is described by Hughes et al in U.S. Pat. No. 4,199,369. This method is an inversion process and involves adding a solution of certain water-soluble anionic dispersing agents in water to molten fortified rosin with continuous agitation to form a water-in-oil emulsion and then adding hot water with vigorous stirring until the emulsion inverts, the water becoming the continuous phase and the rosin becoming the dispersed phase. The preferred dispersing agents used in the inversion process of U.S. Pat. No. 4,199,369 are alkali metal or ammonium salts of alkylphenoxy- or higher alkoxy-poly(ethyleneoxy) ethanol half esters of sulfuric acid.

The hydrophobic cellulose-reactive sizing agents which have been found to be particularly useful as the second component of the dispersed phase are ketene dimers, acid anhydrides and organic isocyanates.

Ketene dimers used as cellulose-reactive sizing agents are dimers having the formula:

$$[R''' CH{=}C{=}O]_2$$

where R''' is a hydrocarbon radical, such as alkyl having at least 8 carbon atoms, cycloalkyl having at least 6 carbon atoms, aryl, aralkyl and alkaryl. In naming ketene dimers, the radical "R" is named followed by "ketene dimer". Thus, phenyl ketene dimer is:

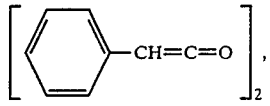

benzyl ketene dimer is:

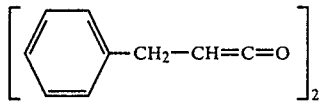

and decyl ketene dimer is $[C_{10}H_{21}{-}CH{=}C{=}O]_2$. Examples of ketene dimers include octyl, decyl, dodecyl, tetradecyl, hexadecyl, octadecyl, eicosyl, docosyl, tetracosyl, phenyl, benzyl, beta-napthyl and cyclohexyl ketene dimers, as well as the ketene dimers prepared by known methods from montanic acid, naphthenic acid, $\Delta^{9,10}$-decylenic acid, $\Delta^{9,10}$-dodecylenic acid, palmitoleic acid, oleic acid, ricinoleic acid, linoleic acid, and eleostearic acid, as well as ketene dimers prepared from naturally occurring mixtures of fatty acids, such as those mixtures found in coconut oil, babassu oil, palm kernel oil, palm oil, olive oil, peanut oil, rape oil, beef tallow, lard (leaf) and whale blubber. Mixtures of any of the above-named fatty acids with each other may also be used.

Acid anhydrides useful as cellulose-reactive sizing agents for paper are well-known in the art and include (A) rosin anhydride, see U.S. Pat. No. 3,582,464; (B) anhydrides having the structure

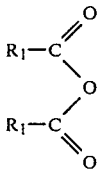

(I)

where $R_1$ is a saturated or unsaturated hydrocarbon radical, the hydrocarbon radical being a straight or branched chain alkyl radical, an aromatic substituted alkyl radical, or an alkyl substituted aromatic radical so long as the hydrocarbon radical contains a total of from about 14 to 36 carbon atoms; and (C) cyclic dicarboxylic acid anhydrides having the structure:

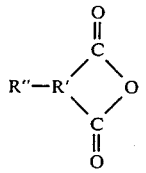

(II)

where R′ represents a dimethylene or trimethylene radical and where R″ is a hydrocarbon radical containing more than 7 carbon atoms and is preferably alkyl, alkenyl, aralkyl or aralkenyl. Substituted cyclic dicarboxylic acid anhydrides falling within the above formula (II) are substituted succinic and glutaric anhydrides. In formula (I) above each $R_1$ can be the same hydrocarbon radical or each $R_1$ can be a different hydrocarbon radical.

Specific examples of anhydrides of formula (I) are myristoyl anhydride; palmitoyl anhydride; oleoyl anhydride; and stearoyl anhydride.

Specific examples of anhydrides of formula (II) are isooctadecenyl succinic acid anhydride; n-hexadecenyl succinic acid anhydride; dodecyl succinic acid anhydride; decenyl succinic acid anhydride; octenyl succinic acid anhydride; and heptyl glutaric acid anhydride.

Hydrophobic organic isocyanates used as sizing agents for paper are well-known in the art. Best results are obtained when the hydrocarbon chains of the isocyanates contain at least 12 carbon atoms, preferably from 14 to 36 carbon atoms. Such isocyanates include rosin isocyanate; dodecyl isocyanate; octadecyl isocyanate; tetradecyl isocyanate; hexadecyl isocyanate; eicosyl isocyanate; docosyl isocyanate; 6-ethyldecyl isocyanate; 6-phenyldecyl isocyanate; and polyisocyanates such as 1,18-octadecyl diisocyanate and 1,12-dodecyl diisocyanate, wherein one long chain alkyl group serves two isocyanate radicals and imparts hydrophobic properties to the molecule as a whole.

Aqueous dispersions or emulsions containing finely divided particles of hydrophobic cellulose-reactive sizing agents are known commercially. Such dispersions are conventionally prepared by stirring the cellulose-reactive sizing agent into an aqueous solution of an emulsifier and passing the premix through an homogenizer. Emulsifiers conventionally employed in the production of emulsions of cellulose-reactive sizing agents are suitable. Such emulsifiers include cationic starches that are water-soluble starches containing sufficient amino groups, quaternary ammonium or other cationic groups to render the starch, as a whole, cellulose substantive. Examples of such cationic starches are the cationic amine-modified starches described in U.S. Pat. No. 3,130,118 and the known cationic starch graft copolymers. Other emulsifiers are the water-soluble cationic thermosetting resins obtained by reacting epichlorohydrin with a water-soluble aminopolyamide formed from a 3 to 10 carbon dibasic carboxylic acid and a polyalkylene polyamine containing from 2 to 8 alkylene groups (see U.S. Pat. Nos. 2,926,116 & 2,926,154), with a water-soluble poly(diallylamine) (see U.S. Pat. No. 3,966,654), with condensates of dicyandiamide or cyanamide and a polyalkylenepolyamine (see U.S. Pat. No. 3,403,113), with bis-aminopropylpiperazine or condensates thereof with dicyandiamide or cyanamide (see U.S. Pat. No. 4,243,481) and the like.

The dispersed phase of the cationic aqueous dispersions of this invention contains both finely divided particles of a hydrophobic cellulose-reactive size and finely divided particles of fortified rosin and it has been found that the dispersed phase should comprise at least 10 weight % of each if the advantages of this invention are to be realized. Thus, the weight ratio of the fortified rosin size to the cellulose-reactive size will range from 0.1:1 to 10:1. The most practical range, however, is from 0.2:1 to 5:1 and this is the preferred range.

The aqueous dispersions of this invention also contain, as stated, a water-soluble nitrogen-containing cationic dispersing agent. Any cationic nitrogen-containing dispersing agent which is water-soluble and confers a positive surface charge to the particles of the disperse phase of the dispersion is suitable. Nitrogen-containing dispersing agents of this type are well-known to the art and are available commercially. Typically, the dispersing agents are quaternary ammonium compounds; homopolymers or copolymers of ethylenically unsaturated amines; the resinous reaction products of epihalohydrins and polyaminopolyamides, alkylenepolyamines, poly(diallylamines), bis-aminopropylpiperazine, dicyandiamide (or cyanamide) -polyalkylene polyamine condensates, dicyandiamide (or cyanamide) -formaldehyde condensates, and dicyandiamide (or cyanamide) -bis-aminopropylpiperazine condensates; and cationic starches and particularly starch ethers containing amino or quaternary ammonium groups. Particularly preferred are cationic starch and the resinous reaction products of epichlorohydrin with an aminopolyamide, an alkylenepolyamine, a poly(diallylamine) or a dicyandiamidepolyalkylenepolyamine condensate. The dispersing agents can be used singly, in combination with each other or in combination with anionic or nonionic dispersing agents.

The minimum amount of cationic dispersing agent used must, of course, be sufficient to render the dispersion cationic. The amount used will vary, of course, depending upon the water solubility and the cationic strength of the particular agent employed. Usually, the amount will range from about 5 to about 140, preferably 20 to 120 and more preferably from 40 to 100 weight % based on the dispersed phase. Amounts less than about 5% generally are not sufficient to render the dispersion cationic and amounts greater than about 140% have not been found to provide additional advantages and hence are not necessary.

The cationic dispersions of this invention can be prepared at any convenient concentration. Particularly useful are dispersions in which the dispersed phase is about 5 to 70%, preferably 10 to 55%, the dispersing agent is 1 to 15%, preferably 2 to 10% and the balance is water to 100%. The dispersions of this invention can also contain other sizing or non-sizing ingredients provided their presence does not destroy the advantages of the invention. Particularly useful in this respect is alum which is conventionally used to set rosin size. Ordinarily, alum cannot be added to fortified rosin prior to its use as a sizing agent for paper and must be added separately to an aqueous suspension of papermaking fibers at various stages prior to sheet formation for internal sizing or applied to the formed sheet prior to, simultaneously with or following application of the rosin in external sizing. Now it has been found that alum in any amount can be present in the aqueous cationic dispersions of this invention without destroying size efficiency and that the presence of alum provides an outstanding advantage in convenience which was not realizable heretofore. In general, when alum is present, the amount will range from about 25 to about 200% based on the weight of fortified rosin particles. The most practical range, however, is 75 to 150% and this is the preferred range. Other additives such as preservatives can also be present in small amounts.

The novel dispersions of this invention can be prepared by blending a preformed cationic dispersion of the fortified rosin particles with a preformed cationic dispersion of the hydrobic cellulose-reactive sizing agent. They can also be prepared by mixing a melt or organic solution of fortified rosin and the cellulose-reactive size in aqueous medium containing the cationic dispersing agent and subjecting the mixture to conditions of extreme shear, as set forth above. Modifications of the above procedures are also suitable and are within the skill of the art to which the invention pertains.

The dispersions of this invention are particularly useful for internal or surface sizing of paper and maximize the advantages of the individual sizing components while minimizing the disadvantages. The dispersions provide improved sizing under conditions which are not practical for cellulose-reactive size dispersions alone or for fortified rosin dispersions alone, and also provide the fast rate of cure typical of fortified rosin size and the high degree of sizing typical of the cellulose-reactive sizes. Thus, by means of this invention it is possible to control readily the rate and degree of sizing under normal paper mill conditions wherein alum is usually present and to use pH levels which provide paper having excellent permanence and durability. The aqueous dispersions can be added to the pulp suspension at any point after refining is complete and prior to sheet formation or can be applied to the sheet on the paper machine, as for example, at the size press. For either of these uses, it is not necessary to prepare the aqueous dispersion in advance and similar advantages can be achieved by an in situ formation of the dispersion that is, by separately adding to the pulp suspension at the same or at different locations, a preformed cationic dispersion of fortified rosin and a preformed cationic dispersion of the cellulose-reactive sizing agent and intimately blending the dispersions with the pulp prior to sheet formation. Similarly, the aqueous dispersions of this invention can be formed in situ at the size press by simultaneous or separate additions of the individual cationic components in dispersion form and blending.

The amount of dispersion added to the aqueous pulp suspension (internal sizing) or to the formed paper sheet (external sizing) should be such as to provide a retained amount of from about 0.01 to about 1% and preferably from about 0.01 to 0.5% by weight of the combination of cellulose-reactive size and fortified rosin, based on the dry weight of fiber.

Having generally outlined the embodiments of this invention, the following examples constitute specific illustrations thereof. All parts and percentages are by weight unless otherwise specified.

EXAMPLE A

A ketene dimer dispersion having a total solids of 15% and containing 5.4% ketene dimer solids, 1.4% cationic starch and 8.2% of a cationic resin prepared by condensing 1 mole of dicyandiamide with 1 mole of diethylenetriamine, and reacting the condensate with 1.2 mole of epichlorohydrin was prepared as follows.

An emulsion of a ketene dimer prepared from a mixture of palmitic and stearic acids was prepared by admixing 880 parts of water, 50 parts of cationic corn starch and 10 parts of sodium lignin sulfonate. The mixture was adjusted to a pH of about 3.5 with 98% sulfuric acid and heated at 90°–95° C. for about 1 hour. Water was then added to the mixture in an amount sufficient to provide a mixture of 1760 parts (total weight). Then 240 parts of the ketene dimer were stirred into the mixture and the mixture (at 65° C.) was homogenized in one pass through an homogenizer at 4000 p.s.i. The homogenized product (at 15% total solids and 12% ketene dimer solids, 136.4 parts) was then mixed with 136.4 parts of an 18% aqueous solution of the cationic resin and 27.2 parts of water and the pH was adjusted to 4.0 to 4.5.

EXAMPLE B

A cationic dispersion of fortified rosin having a total solids content of 34.1% and containing 28.4% of rosin solids and 5.7% of a cationic resinous reaction product of 1.25 moles of epichlorohydrin with an aminopolyamide derived from 1 mole of adipic acid and 0.97 mole of diethylenetriamine was prepared as follows.

A solution was prepared by dissolving 300 parts of fortified rosin in 200 parts of methylene chloride over a 20-minute period. The fortified rosin contained 7.5% fumaric acid, substantially all of which was in the combined or adducted form. The fortified rosin was prepared by adducting 22.5 parts of fumaric acid with 277.5 of formaldehyde treated tall oil rosin at a temperature of about 205° C. until substantially all of the furmaric acid had reacted and then cooling the fortified rosin to room temperature. The fortified rosin solution was thoroughly mixed with a preblend of 480 parts of the aminopolyamide/epichlorohydrin resin at 12.5% solids and 260 parts water and the mixture was homogenized twice at 3000 p.s.i. The methylene chloride was subsequently removed by distillation under reduced pressure at 60° C. The product was cooled and filtered through a 100 mesh screen, giving 750 parts of a dispersion having a viscosity of 51 cps.

EXAMPLES 1 to 8

Various compositions were prepared by mixing in a vessel equipped with a magnetic stirrer 50 parts of the cationic dispersion of Example A and from about 9 to about 59 parts of the cationic dispersion of Example B. Details of these examples and the resulting cationic dispersions are set forth in Table I, below.

TABLE 1

| | Ex. 1 | Ex. 2 | Ex. 3 | Ex. 4 | Ex. 5 | Ex. 6 | Ex. 7 | Ex. 8 |
|---|---|---|---|---|---|---|---|---|
| Composition | | | | | | | | |
| Ex. A (parts) | 50 | 50 | 50 | 50 | 50 | 50 | 50 | 50 |
| Ex. B (parts) | 15.1 | 43.9 | 10.9 | 58.7 | 28.6 | 36.6 | 18.6 | 9.3 |
| Dispersed Phase | | | | | | | | |
| Fortified Rosin(1) | 6.60 | 13.28 | 5.08 | 15.34 | 10.33 | 12.00 | 7.70 | 4.45 |
| Ketene Dimer(1) | 4.19 | 2.90 | 4.48 | 2.51 | 3.47 | 3.15 | 3.98 | 4.60 |
| Rosin:Dimer | | | | | | | | |
| Rosin: Dimer ratio | 1.6 | 4.6 | 1.1 | 6.1 | 3.0 | 3.8 | 1.9 | 1.0 |

TABLE 1-continued

| | Ex. 1 | Ex. 2 | Ex. 3 | Ex. 4 | Ex. 5 | Ex. 6 | Ex. 7 | Ex. 8 |
|---|---|---|---|---|---|---|---|---|
| Continuous Phase | | | | | | | | |
| Dispersing Agent(1)(2) | 8.65 | 7.74 | 8.85 | 7.47 | 8.14 | 7.92 | 8.50 | 8.93 |
| Water(1) | 80.6 | 76.1 | 81.6 | 74.7 | 78.1 | 76.9 | 79.8 | 81.0 |
| Dispersing Agent(2) as % of Dispersed Phase | 80.2 | 47.8 | 92.6 | 41.8 | 59.0 | 52.3 | 72.8 | 98.7 |
| Total Solids, % | 19.72 | 23.96 | 18.47 | 25.30 | 21.95 | 23.09 | 20.04 | 17.86 |

Footnotes for Table I.
(1)%, based on the weight of the composition.
(2)Mixture of cationic starch, cationic resinous reaction product of dicyandiamide, diethylenetriamine and epichlorohydrin and cationic resinous reaction product of adipic acid, diethylenetriamine and epichlorohydrin.

EXAMPLE 9

The sizing efficiency of each of the aqueous cationic dispersions of Examples 1 to 5 was tested by preparing handsheets using varying amounts of size solids. To prepare the handsheets, a 50:50 blend of Rayonier bleached softwood and Weyerhaeuser bleached hardwood kraft pulp was suspended in standard hard water and beaten to 500 Canadian standard freeness in a Noble and Wood cycle beater. The pulp slurry was diluted to a consistency of 0.25% in the proportioner. A 2-liter portion of the slurry was treated with sufficient of the cationic dispersion to give various percentages of size, and with sufficient papermakers alum to give 0.5% alum, based on the weight of the pulp and diluted to 0.025% consistency in order to form a 40 pound/3000 ft.$^2$ sheet at a pH of 6.5 using a Noble and Wood sheet making apparatus. The formed sheets were wet-pressed to 33% solids content and then dried at 105° C. for 45 seconds on a steam drum drier to 3–4% moisture. The sheets were tested for size properties using the Hercules Size Test with test solution No. 2 to 80% reflectance. The off-machine data were obtained within two minutes of drying and the natural aged data after 7 days of storage at room temperature and 50% relative humidity. Size results for these trials and for 7 controls prepared in the same manner except that the dispersion of Example A or Example B was added to the portion of slurry are set forth in Table II, below.

TABLE II

| Sizing Composition of Example | Sizing Level (%) | Hercules Sizing Test (seconds) | |
|---|---|---|---|
| | | Off-the-Machine | Natural Aged |
| 1 | 0.25 | 393 | 537 |
| 2 | 0.30 | 317 | 434 |
| 3 | 0.30 | 540 | 739 |
| 4 | 0.275 | 185 | 175 |
| 5 | 0.35 | 514 | 694 |
| A | 0.075(1) | 1 | 1 |
| A | 0.10(1) | 10 | 12 |
| A | 0.15(1) | 247 | 320 |
| A | 0.20(1) | 428 | 579 |
| B | 0.10 | 0 | 0 |
| B | 0.20 | 3 | 2 |
| B | 0.40 | 62 | 64 |

(1)The papermakers alum was omitted.

EXAMPLE 10

The aqueous dispersions of Examples 6 to 8 were used to prepare internally sized paper on a pilot paper machine. The paper was made from a 50:50 blend of hardwood and softwood kraft pulp beaten to a Canadian standard freeness of 500 and formed into sheets having a basis weight of 40 pounds/3000 ft.$^2$ at a pH of 6.4 to 6.6. Each dispersion was added to the thick stock just prior to dilution at the fan pump. Papermakers alum, if used, was added simultaneously with the dispersion. The sized sheets were dried to 3% moisture before the size press and to 4% moisture at the reel. The size press contained a 6% solution of oxidized corn starch. The sizing was measured by the Hercules Size Test with test solution No. 2 to 80% reflectance on samples taken before the size press, at the reel (off-the-machine) and after 7 days storage at room temperature and 50% relative humidity. The size test results for these trials and for 6 controls prepared in the same manner except that the dispersion of Example A or Example B was added to the thick stock are set forth in Table III, below.

TABLE III

| Trial | Sizing Composition of Example | Sizing Level (%) | Hercules Sizing Test (seconds) | | | |
|---|---|---|---|---|---|---|
| | | | Alum (%) | Before Size Press | Off-the-Machine | Natural Aged |
| 1 | 6 | 0.16 | 0.25 | 9 | 22 | 114 |
| 2 | 6 | 0.32 | 0.25 | 170 | 220 | 745 |
| 3 | 7 | 0.225 | 0.25 | 33 | 73 | 492 |
| 4 | 8 | 0.35 | 0.25 | 611 | 391 | 947 |
| 5 | A | 0.125 | — | 47 | 34 | 90 |
| 6 | A | 0.25 | — | 597 | 560 | 950 |
| 7 | A | 0.125 | 0.25 | 0 | 0 | 86 |
| 8 | B | 0.10 | 0.25 | 0 | 0 | 0 |
| 9 | B | 0.20 | 0.25 | 5 | 6 | 6 |
| 10 | B | 0.20 | 0.50 | 18 | 55 | 55 |

The foregoing Table clearly demonstrates that marked improvement in sizing is obtained with the compositions of this invention under conditions which are not practical for ketene dimer dispersions alone (control trial 7) or for fortified rosin dispersions alone (control trials 8 and 9). The data further show that the compositions of this invention provide the fast rate of cure typical of rosin size and the high degree of sizing typical of ketene dimer size, and that the rate and degree of sizing can be controlled readily under normal mill conditions wherein alum is usually present and at pH levels which provide paper with excellent permanence and durability.

EXAMPLE C

A dispersion having a total solids of 51% and containing by weight 21.2% of fortified rosin, 4.3% of the cationic resinous reaction product of Example B and 25.5% of alum was prepared by blending 50 parts of the dispersion of Example B with 17.1 parts of alum ($Al_2(SO_4)_3.18H_2O$).

EXAMPLES 11 and 12

Two compositions were prepared by mixing in a vessel equipped with a magnetic stirrer 50 parts of the cationic dispersion of Example A and 30 parts (Example 11) or 60 parts (Example 12) of the dispersion of Example C. The cationic dispersion of Example 11 contained, by weight of the total composition, 7.95% of fortified rosin, 3.41% of ketene dimer, 7.58% of the mixed cationic dispersing agent and 9.56% of alum and had a total solids content of 28.5%. The cationic dispersion of Example 12 contained, by weight of the total composition, 11.56% of fortified rosin, 2.48% of ketene dimer, 6.68% of the mixed dispersing agent and 13.90% of alum and had a total solids content of 34.6%.

The efficiency of the aqueous dispersions of these examples to surface size paper was evaluated using unsized bleached kraft paper (40 lbs./3000 ft.$^2$) made at a pH of 6.5. The sheets were treated using a small horizontal laboratory size press by adding samples of the aqueous dispersions to the nip of the size press and passing sheets of paper through the dispersion before being squeezed by the rolls of the size press. Under these conditions the sheets picked up about 70% of their weight of size press dispersion. The sized sheets were dried for about 20 seconds at 93° C. to a moisture content of about 5%. Sizing was determined by the Hercules Size Test using test solution No. 2 to a reflectance of 80% within 2 minutes of drying (off-the-machine) and after 7 days of storage at room temperature and 50% relative humidity (natural aged). The size results for these examples and for five controls wherein paper was treated in the same manner except that the dispersions of Examples A, B or C were used as the sizing composition, are set forth below in Table IV.

TABLE IV

| Sizing Composition of Example | Level of Addition % | Hercules Size Test (seconds) Off-the-Machine | Natural Aged |
|---|---|---|---|
| 11 | 0.21 | 23 | 320 |
| 12 | 0.175 | 8 | 35 |
| A | 0.035 | 0 | 5 |
| A | 0.07 | 4 | 160 |
| B | 0.07 | 0 | 0 |
| B | 0.07[1] | 7 | 15 |
| C | 0.14 | 8 | 14 |

[1]Alum, in an amount equal to 0.07% based on the weight of dry pulp, was added to the nip of the size press, as an aqueous solution simultaneously with the dispersion of Example B.

I claim:

1. As a composition of matter, a cationic aqueous dispersion having as the continuous phase an aqueous solution containing at least one water-soluble nitrogen-containing cationic dispersing agent and as the dispersed phase (a) finely divided particles of fortified rosin and (b) finely divided particles of a hydrophobic, cellulose-reactive ketene dimer sizing agent, the weight ratio of (a):(b) in said dispersed phase being within the range of 0.1:1 to 10:1, and the amount of dispersing agent being within the range of about 5 to about 140% based on the weight of the dispersed phase.

2. The composition of claim 1 in which the aqueous dispersion also contains from about 25 to about 200% alum based on the weight of fortified rosin particles.

3. The composition of claim 1 in which the ketene dimer is an alkyl ketene dimer wherein the alkyl group contains at least 8 carbon atoms.

4. The composition of claim 3 in which the dispersing agent is selected from the group consisting of cationic starches and the resinous reaction products of epichlorohydrin with an aminopolyamide, an alkylenepolyamine, a poly(diallylamine) or a dicyandiamide-polyalkylenepolyamine condensate.

5. A method of sizing paper or paper board from cellulose stock which comprises applying as a size in a papermaking machine sizing process, the composition of claim 1.

6. The method of claim 5 wherein the sizing process is an internal sizing process.

7. The method of claim 5 wherein the sizing process is a surface sizing process.

8. The composition of claim 4 in which the amount of dispersion agent is within the range of about 40% to about 100% based on the weight of the dispersed phase.

9. The composition of claim 8 in which the aqueous dispersion also contains from about 75% to about 150% alum based on the weight of fortified rosin particles.

10. A method of sizing paper or paper board from cellulose stock which comprises applying as a size in a papermaking machine sizing process, the composition of claim 9.

* * * * *